US008936033B2

(12) United States Patent
Velarde

(10) Patent No.: US 8,936,033 B2
(45) Date of Patent: Jan. 20, 2015

(54) WALKING APPARATUS

(71) Applicant: Arvin Jay D. Velarde, Fairfield, CA (US)

(72) Inventor: Arvin Jay D. Velarde, Fairfield, CA (US)

( * ) Notice: Subject to any disclaimer, the term of this patent is extended or adjusted under 35 U.S.C. 154(b) by 0 days.

(21) Appl. No.: 13/836,968

(22) Filed: Mar. 15, 2013

(65) Prior Publication Data

US 2014/0261591 A1 Sep. 18, 2014

(51) Int. Cl.

| | |
|---|---|
| ***A61H 3/04*** | (2006.01) |
| ***A45B 9/04*** | (2006.01) |
| ***A61H 3/00*** | (2006.01) |

(52) U.S. Cl.

CPC ..... *A61H 3/00* (2013.01)
USPC ..... 135/67; 135/84; 135/85; 135/77

(58) Field of Classification Search

CPC ..... A61H 3/00; A61H 3/04; A61H 2003/001
USPC ..... 135/65, 67, 70, 77, 84, 85, 78
See application file for complete search history.

(56) References Cited

U.S. PATENT DOCUMENTS

| | | | | |
|---|---|---|---|---|
| 3,455,313 | A * | 7/1969 | King | 135/67 |
| 4,251,105 | A * | 2/1981 | Barker | 297/6 |
| 4,640,301 | A * | 2/1987 | Battiston et al. | 135/67 |
| 4,700,730 | A * | 10/1987 | Samuelson et al. | 135/67 |
| 6,145,524 | A * | 11/2000 | Li et al. | 135/67 |
| 6,688,437 | B2 * | 2/2004 | Usherovich | 188/2 F |
| 2003/0178053 | A1 * | 9/2003 | Wilensky et al. | 135/67 |
| 2008/0078431 | A1 * | 4/2008 | Battiston | 135/67 |
| 2009/0301533 | A1 * | 12/2009 | Caldwell | 135/67 |
| 2011/0272913 | A1 * | 11/2011 | Diamond | 280/288.2 |

FOREIGN PATENT DOCUMENTS

| | | | |
|---|---|---|---|
| GB | 2074033 | A * | 10/1981 |

* cited by examiner

*Primary Examiner* — David R Dunn
*Assistant Examiner* — Danielle Jackson
(74) *Attorney, Agent, or Firm* — Morgan, Lewis & Bockius LLP

(57) ABSTRACT

A walker for aiding locomotion comprises a frame structure including: a first and second side frame comprising (i) a first and second anterior frame portion, (ii) a first and second posterior frame portion, and (iii) a first superior frame portion connecting an upper end of the first anterior frame portion with an upper end of the first posterior frame portion, and (iv) a second superior frame portion connecting an upper end of the second anterior frame portion with an upper end of the second posterior frame portion. The first posterior frame portion of the first side frame comprises a first upper posterior collar and the second posterior frame portion of the second side frame comprises a second upper posterior collar. A first and second rotatable hand-rail are connected pivotally to the first and second upper posterior collar of the first and second posterior frame portion.

17 Claims, 9 Drawing Sheets

WALKING APPARATUS

TECHNICAL FIELD

The disclosed embodiments relate generally to apparatus for aiding locomotion and more specifically to a walking aide or a walker.

BACKGROUND

People frequently suffer from difficulty walking arising out of physical aging and often debilitating aging-related musculo-skeletal conditions, physical injuries (e.g., sports-related injuries), weakening of the lower extremities, neurological illnesses that impact locomotive responses, and the like. In such circumstances, physicians and physical therapists frequently recommend the use of a walking aide or walker to assist with locomotion.

The commonly used walking aide devices (e.g., such as pick-up walkers and front-wheel walkers) that are recommended for use on plane or level surfaces do not lend themselves readily for use on stairways. As a result, there is a need in the art for a walker or walking aide device that can be used to assist locomotion on stairways and on-level surfaces.

SUMMARY

Disclosed is a walking aide apparatus or walker that overcomes the limitation of the prior art walkers by providing structural elements that lend the walker to ease of use on stairways and non-level surfaces. The disclosed walker provides a rotatable hand-rail (e.g., to be used to provide a stable, secure hand-grip) that is configurable to be extended outward for use on steps or non-level surfaces. On level surfaces, the rotatable hand-rail is configured to fold inward to prevent use on level surfaces. Furthermore, the disclosed walker provides a frame end with both a wheel and a flat tip which can be rotatably configured to operate the walker in multiple modes of operation including as a pick-up walker (e.g., especially on stairs so as to provide stable, firm grip on the steps) and as a front-wheel walker (e.g., on flat, level surfaces). Alternatively, or in addition, the disclosed walker includes collars on the lower ends of the frames so as to adjust the ratio of the front (anterior) and back (posterior) frame lengths in order to align side bars horizontally on both the surfaces on steps as well as on flat, level surfaces so as enable a substantially flat plank surface to be placed on the side bars. As such, the plank surface can be placed on the horizontally leveled side bars even when the walker is placed on a stairway and the plank surface is useable as a detachable seat for the user to sit on while ascending or descending a stairway.

In accordance with some embodiments, a walker for aiding locomotion comprises a frame structure including: a first side frame comprising (i) a first anterior frame portion having a first adjustable length, (ii) a first posterior frame portion having a second adjustable length, and (iii) a first superior frame portion having a first fixed length, wherein the first superior frame portion connects an upper end of the first anterior frame portion with an upper end of the first posterior frame portion. The frame structure further includes a second side frame comprising (i) a second anterior frame portion having a third adjustable length, (ii) a second posterior frame portion having a fourth adjustable length, and (iii) a second superior frame portion having a second fixed length, wherein the second superior frame portion connects an upper end of the second anterior frame portion with an upper end of the second posterior frame portion. The first posterior frame portion of the first side frame comprises a first upper posterior collar and the second posterior frame portion of the second side frame comprises a second upper posterior collar. A first rotatable hand-rail is connected pivotally to the first upper posterior collar of the first posterior frame portion of the first side frame and a second rotatable hand-rail is connected pivotally to the second upper posterior collar of the second posterior frame portion of the second side frame.

The walker further comprises an inter-frame support assembly including an anterior support bar connecting the first anterior frame portion of the first frame to the second anterior frame portion of the second frame.

The walker further comprises an intra-frame support assembly including a first side support bar connecting the first anterior frame portion of the first side frame with the first posterior frame portion of the first side frame and a second side support bar connecting the second anterior frame portion of the second side frame with the second posterior frame portion of the second side frame.

In accordance with some embodiments, a walker for aiding locomotion comprises a frame structure including a first side frame comprising (i) a first anterior frame portion having a first adjustable length, (ii) a first posterior frame portion having a second adjustable length, and (iii) a first superior frame portion having a first fixed length, wherein the first superior frame portion connects an upper end of the first anterior frame portion with an upper end of the first posterior frame portion. the frame structure further comprises a second side frame comprising (i) a second anterior frame portion having a third adjustable length, (ii) a second posterior frame portion having a fourth adjustable length, and (iii) a second superior frame portion having a second fixed length, wherein the second superior frame portion connects an upper end of the second anterior frame portion with an upper end of the second posterior frame portion.

A lower end of the first anterior frame portion comprises (i) a first angular segment formed at a fixed angle relative to a remaining portion of the first anterior frame portion, the first angular segment terminating in a first anterior tip, and (ii) a first anterior wheel connected to the first angular segment through a first wheel-connection joint.

A lower end of the second anterior frame portion comprising (i) a second angular segment formed at the fixed angle relative to a remaining portion of the second anterior frame portion, the second angular segment terminating in a second anterior tip, and (ii) a second anterior wheel connected to the second angular segment through a second wheel-connection joint.

The walker is configured to operate in a plurality of modes including: (i) a first mode of operation characterized by a posterior-facing orientation of the first wheel and a posterior-facing orientation of the second wheel and a corresponding anterior-facing orientation of the first anterior tip and an anterior-facing orientation of the second anterior tip such that the first anterior tip and the second anterior tip make contact with a surface on which the walker rests; and (ii) a second mode of operation characterized by an anterior-facing orientation of the first anterior wheel and an anterior-facing orientation of the second anterior wheel and a corresponding posterior-facing orientation of the first anterior tip and a posterior-facing orientation of the second anterior tip such that the first anterior wheel and the second anterior wheel make contact with the surface on which the walker rests.

In accordance with some embodiments, a walker for aiding locomotion comprises: a first side frame comprising (i) a first anterior frame portion having a first adjustable length, (ii) a first posterior frame portion having a second adjustable length, (iii) a first superior frame portion having a first fixed length and connecting an upper end of the first anterior frame portion with an upper end of the first posterior frame portion, and (iv) a first side support bar connecting the first anterior frame portion of the first side frame with the first posterior frame portion. The walker further comprises a second side frame comprising (i) a second anterior frame portion having a third adjustable length, (ii) a second posterior frame portion having a fourth adjustable length, (iii) a second superior frame portion having a second fixed length, connecting an upper end of the second anterior frame portion with an upper end of the second posterior frame portion, and (iv) a second side support bar connecting the second anterior frame portion of the second side frame with the second posterior frame portion of the second side frame. When the first and second posterior frame portion are placed on a first surface and the first and second anterior frame portion are placed on a second surface, the first surface being at a predetermined elevation above the second surface: (i) the first and second side support bar are parallel to both the first and second surface, and (ii) a substantially planar plank surface balanced on the first and second side support bar lies in a plane parallel to both the first and second surface and forms a detachable seat.

BRIEF DESCRIPTION OF THE DRAWINGS

Like reference numerals refer to corresponding parts throughout the drawings.

DESCRIPTION OF EMBODIMENTS

It will also be understood that, although the terms "first," "second," etc. may be used herein to describe various elements, these elements should not be limited by these terms. These terms are only used to distinguish one element from another. For example, a first tip could be termed a second tip, and, similarly, a second tip could be termed a first tip, without changing the meaning of the description, so long as all occurrences of the "first tip" are renamed consistently and all occurrences of the second tip are renamed consistently. The first tip and the second tip are both tips, but they are not the same tip.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined (that a stated condition precedent is true)" or "if (a stated condition precedent is true)" or "when (a stated condition precedent is true)" may be construed to mean "upon determining" or "in response to determining" or "in accordance with a determination" or "upon detecting" or "in response to detecting" that the stated condition precedent is true, depending on the context.

Reference will now be made in detail to various embodiments, examples of which are illustrated in the accompanying drawings. In the following detailed description, numerous specific details are set forth in order to provide a thorough understanding of the invention and the described embodiments. However, the invention may be practiced without these specific details. In other instances, well-known methods, procedures, components, and circuits have not been described in detail so as not to unnecessarily obscure aspects of the embodiments.

Figure 1A:
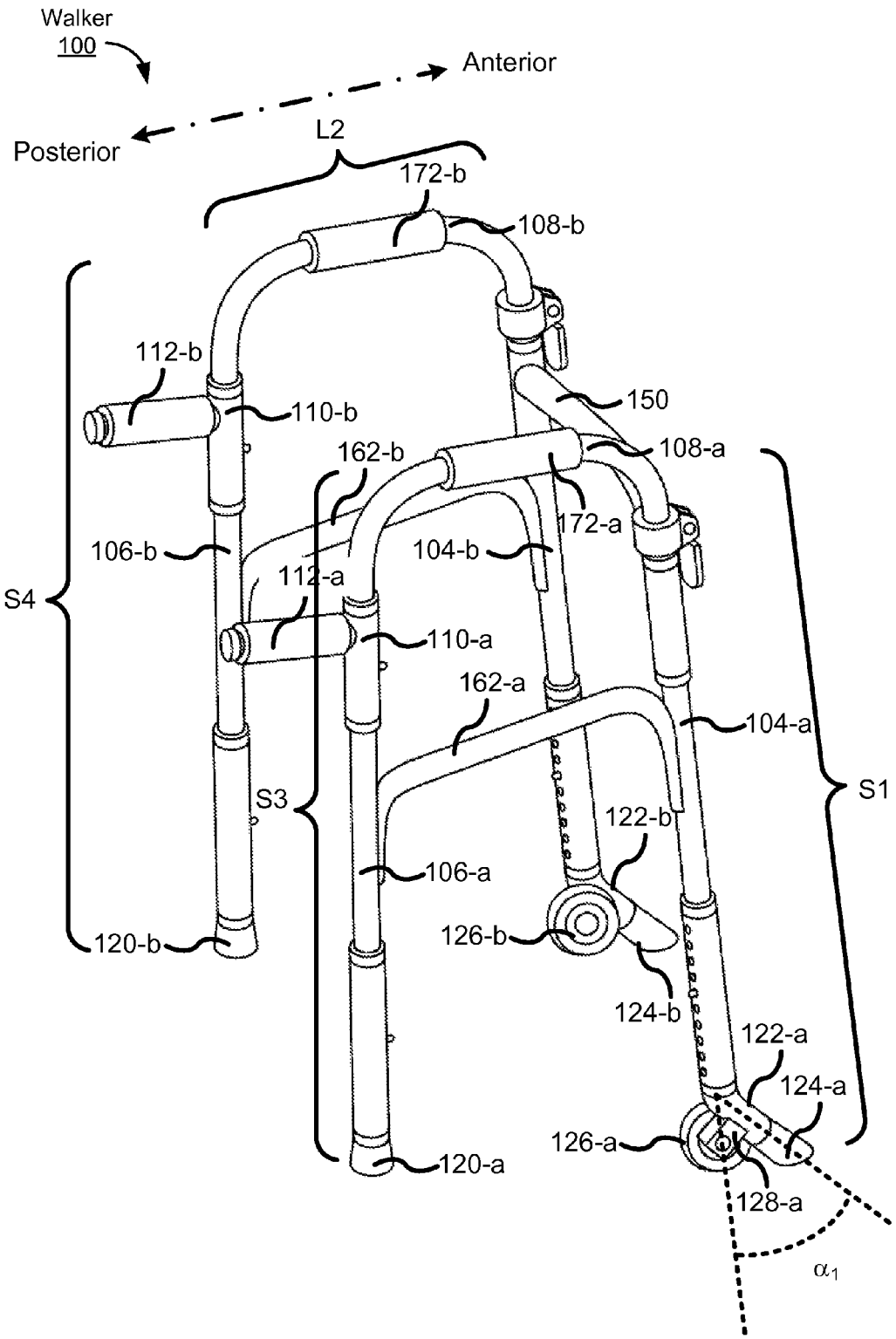
FIGS. 1A-1B illustrate respectively a first and second perspective view of a walking apparatus (e.g., a walker for aiding locomotion) for aiding locomotion, in accordance with some embodiments of the present disclosure.
Figure 1B:
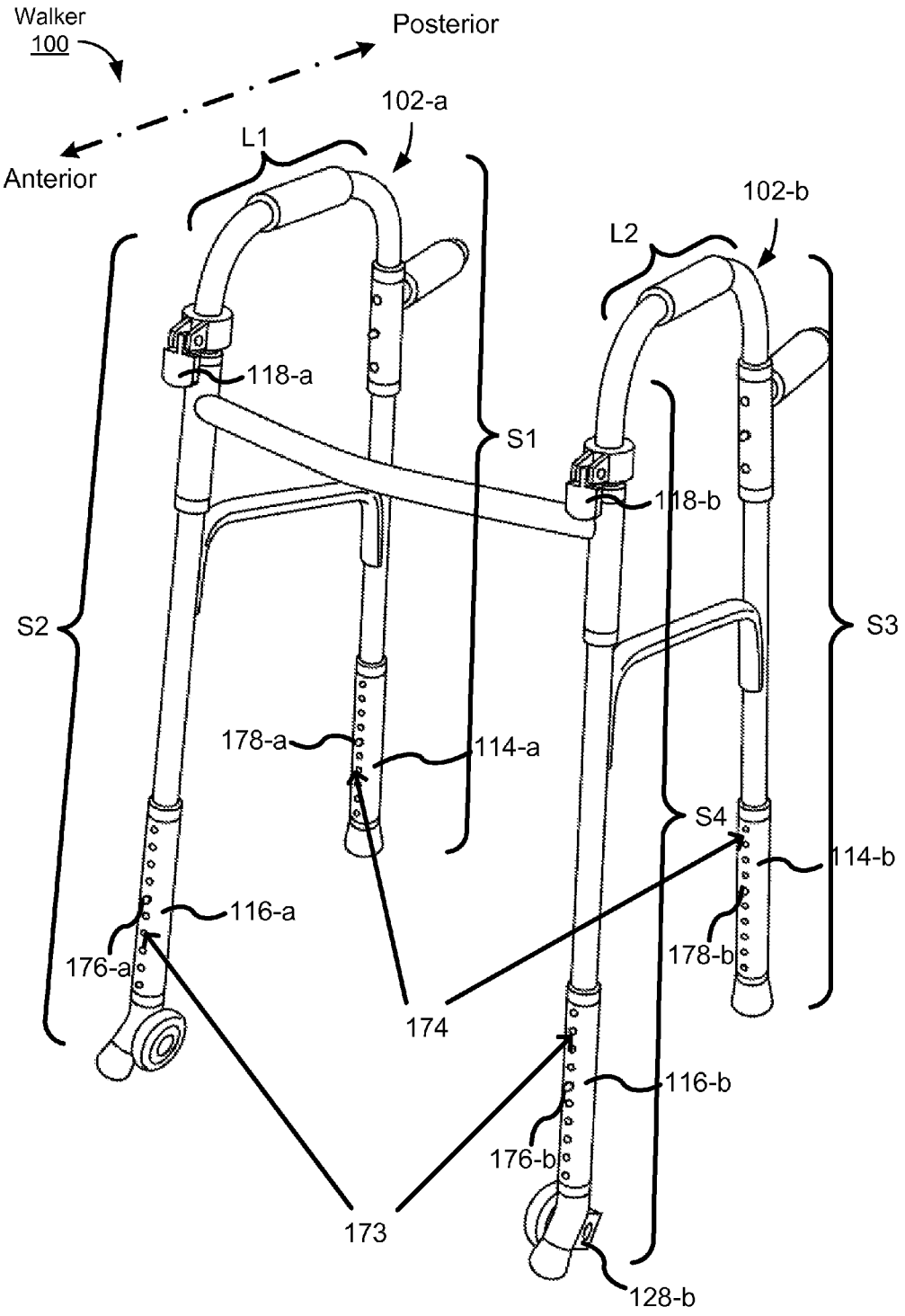

FIGS. 1A-1B illustrate respectively a first and second perspective view of a walking apparatus (e.g., a walker for aiding locomotion) for aiding locomotion, in accordance with some embodiments of the present disclosure.

FIG. 1A illustrates a walker 100 for aiding locomotion; the walker comprises a frame structure, an inter-frame support assembly and an intra-frame support assembly.

The frame structure includes a first (e.g., U-shaped) side frame 102-*a* comprising (i) a first anterior (e.g., front) frame portion 104-*a* having a first adjustable length S1, (ii) a first posterior (e.g., rear) frame portion 106-*a* having a second adjustable length S2, and (iii) a first superior (e.g., upper) frame portion 108-*a* having a first fixed length L1. The first superior frame portion 108-*a* connects an upper end of the first anterior frame portion 104-*a* with an upper end of the first posterior frame portion 106-*a*.

The frame structure further includes a second (e.g., U-shaped) side frame 102-*b* comprising (i) a second anterior (e.g., front) frame portion 104-*b* having a third adjustable length S3, (ii) a second posterior (e.g., rear) frame portion 106-*b* having a fourth adjustable length S4, and (iii) a second superior (e.g., upper) frame portion 108-*b* having a second fixed length L2. The second superior frame portion 108-*b* connects an upper end of the second anterior frame portion 104-*b* with an upper end of the second posterior frame portion 106-*b*.

The first posterior frame portion 106-*a* of the first side frame 102-*a* comprises a first upper posterior collar 110-*a* and the second posterior frame portion 106-*b* of the second side frame 102-*b* comprises a second upper posterior collar 110-*b*. A first rotatable hand-rail 112-*a* is connected pivotally to the first upper posterior collar 110-*a* of the first posterior frame portion 106-*a* of the first side frame 102-*a* and a second rotatable hand-rail 112-*b* is connected pivotally to the second upper posterior collar 110-*b* of the second posterior frame portion 106-*b* of the second side frame 102-*b*.

In some embodiments, a lower end of the first posterior frame portion 106-*a* terminates in a first tip 120-*a*. A lower end of the second posterior frame portion 106-*b* terminates in a second tip 120-*b*.

In some embodiments, a lower end of the first anterior frame portion 104-*a* comprises (i) a first angular segment 122-*a* formed at a fixed angle α1 relative to a remaining portion of the first anterior frame portion 106-*a*, the first angular segment 122-*a* terminating in a third tip 124-*a*, and (ii) a first wheel 126-*a* connected to the first angular segment 122-*a* through a first wheel-connection joint 128-*a*. A lower end of the second anterior frame portion 104-*b* comprises (i) a second angular segment 122-*b* formed at the fixed angle α1 relative to a remaining portion of the second anterior frame portion 106-*b*, the second angular segment 122-*b* terminating in a fourth tip 124-*b*, and (ii) a second wheel 126-*b* connected to the second angular segment 122-*b* through a second wheel-connection joint 128-*b*.

The inter-frame support assembly includes an anterior support bar 150 connecting the first anterior frame portion 104-*a* of the first frame 102-*a* to the second anterior frame portion 104-*b* of the second frame 102-*b*.

The intra-frame support assembly includes a first side support bar 162-*a* connecting the first anterior frame portion 104-*a* of the first side frame 102-*a* with the first posterior frame portion 106-*a* of the first side frame 102-*a* and a second side support bar 162-*b* connecting the second anterior frame portion 104-*b* of the second side frame 102-*b* with the second posterior frame portion 106-*b* of the second side frame 102-*b*.

In some embodiments, as shown in FIG. 1B, the first posterior frame portion 106-*a* of the first side frame 102-*a* further comprises a first lower posterior collar 114-*a*. The second posterior frame portion 106-*b* of the second side frame 102-*b* further comprises a second lower posterior collar 114-*b*. The first anterior frame portion 104-*a* of the first side frame 102-*a* comprises a first lower anterior collar 116-*a*. The second anterior frame portion 104-*b* of the second side frame 102-*b* comprises a second lower anterior collar 116-*b*.

In some embodiments, the first and second lower anterior collar 116-*a* and 116-*b* each comprises N slots (e.g., slots 173), where N is a positive integer between 5 and 12 (e.g., N=8 or N=10, and the like). The first and second lower anterior frame portion (e.g., 104-*a* and 104-*b*) each comprises a protrusion (176-*a* and 176-*b*) configured to correspondingly lock into one of the N slots when the first and second lower anterior collar (e.g., 116-*a* and 116-*b*) slidably engage correspondingly with the first and second anterior frame portion (e.g., 104-*a* and 104-*b*), thereby correspondingly defining the first and third adjustable length (e.g., S1 and S3).

In some embodiments, the first and second lower posterior collar 114-*a* and 114-*b* each comprises M slots (e.g., slots 174), where M is a positive integer between 5 and 12 (e.g., M=8 or M=10, and the like). The first and second lower posterior frame portion (e.g., 106-*a* and 106-*b*) each comprises a protrusion (178-*a* and 178-*b*) configured to correspondingly lock into one of the M slots when the first and second lower posterior collar (e.g., 114-*a* and 114-*b*) slidably engage correspondingly with the first and second posterior frame portion (e.g., 106-*a* and 106-*b*), thereby correspondingly defining the second and fourth adjustable length (e.g., S2 and S4).

In some embodiments, the first and third adjustable length (e.g., S1 and S3) of the first and second lower anterior frame portion (e.g., 104-*a* and 104-*b*) are preadjusted (e.g., by a physician or physical therapist) to an optimum length based on a height of the user (e.g., the patient) and do not require to be changed during regular use by the patient. On the other hand, in some embodiments, the second and fourth adjustable length (e.g., S2 and S4) of the first and second lower posterior frame portion (e.g., 106-*a* and 106-*b*) are configurable by the user to adjust a first ratio between the first and second adjustable lengths and a second ratio between the third and fourth adjustable lengths in order to vary the angle of the first and second side bars 162-*a* and 162-*b* (as described further with reference to FIGS. 2A-2B, 3A-3B, and FIGS. 5A-5B).

In some embodiments, one or more of the first and second upper posterior collar (e.g., 110-*a* and 110-*b*), the first and second lower posterior collar (e.g., 114-*a* and 114-*b*), and the first and second lower anterior collar (e.g., 116-*a* and 116-*b*) are coated in a first predetermined color and one or more corresponding rims of the one or more respective collars are coated in a second predetermined color. In some embodiments, the color combinations are selected to in accordance with dual colors representative of sports and sports teams (e.g., based on a user's allegiance to and preference for a specific sport or sport team). This would be aesthetically pleasing and attractive to young users with an active interest in sports and specific allegiance to a specific sports team (e.g., dual colors representative of a specific baseball team).

In some embodiments, the first and second anterior frame portion (e.g., 104-*a* and 104-*b*) comprise respective first and second actuation tongues (e.g., 118-*a* and 118-*b*) for collapsibly folding the walker upon actuation, the first and second actuation tongues extending anteriorly outward to prevent accidental actuation and folding of the walker.

As described with reference to FIGS. 1A-1B, the walker 100 comprises a frame structure including a first (e.g., U-shaped) side frame comprising (i) a first anterior (e.g., front) frame portion having a first adjustable length, (ii) a first posterior (e.g., rear) frame portion having a second adjustable length, and (iii) a first superior (e.g., upper) frame portion having a first fixed length, wherein the first superior frame portion connects an upper end of the first anterior frame portion with an upper end of the first posterior frame portion. The frame structure further comprises a second (e.g., U-shaped) side frame comprising (i) a second anterior (e.g., front) frame portion having a third adjustable length, (ii) a second posterior (e.g., rear) frame portion having a fourth adjustable length, and (iii) a second superior (e.g., upper) frame portion having a second fixed length, wherein the second superior frame portion connects an upper end of the second anterior frame portion with an upper end of the second posterior frame portion a lower end of the first anterior frame portion comprising (i) a first angular segment formed at a fixed angle relative to a remaining portion of the first anterior frame portion, the first angular segment terminating in a first anterior tip, and (ii) a first anterior wheel connected to the first angular segment through a first wheel-connection joint;

A lower end of the second anterior frame portion comprising (i) a second angular segment formed at the fixed angle relative to a remaining portion of the second anterior frame portion, the second angular segment terminating in a second anterior tip, and (ii) a second anterior wheel connected to the second angular segment through a second wheel-connection joint;

The walker is configured to operate in a plurality of modes includes: (i) a first mode of operation (e.g., front wheel walker) characterized by a posterior-facing orientation of the first wheel and a posterior-facing orientation of the second wheel and a corresponding anterior-facing orientation of the first anterior tip and an anterior-facing orientation of the second anterior tip such that the first anterior tip and the second anterior tip make contact with a surface on which the walker rests; and (ii) a second mode of operation (e.g., pick-up walker) characterized by an anterior-facing orientation of the first anterior wheel and an anterior-facing orientation of the second anterior wheel and a corresponding posterior-facing orientation of the first anterior tip and a posterior-facing orientation of the second anterior tip such that the first anterior wheel and the second anterior wheel make contact with the surface on which the walker rests.

In some embodiments, a detachable lower end of the first posterior frame portion 106-*a* terminates in a first posterior tip; and a detachable lower end of the second posterior frame portion 106-*b* terminates in a second posterior tip. In other words, in some embodiments, the first and second posterior frame portion terminate in substantially flat tips (e.g., rather than in wheels).

In some embodiments, a detachable lower end of the first posterior frame portion 106-*a* terminates in a first posterior wheel (e.g., in 4-wheel walker configuration); and a detachable lower end of the second posterior frame portion terminates in a second posterior wheel (e.g., in the 4-wheel walker configuration).

In some embodiments, as explained further with reference to FIGS. 2A-2B and 3A-3B below, when the first and second posterior frame portion (e.g., 106-*a* and 106-*b*) are placed on a first surface (e.g., first surface 250, FIGS. 2A-2B and 3A-3B) and the first and second anterior frame portion 104-*a* and 104-*b* are placed on a second surface (e.g., second surface 260, FIGS. 2A-2B and 3A-3B), the first surface being at a predetermined elevation (e.g., H1) above the second surface, (i) a substantial portion of a respective tip-base of the first posterior tip and the second posterior tip make contact with the first surface, and (ii) a substantial portion of a respective tip-base of the first anterior tip and the second anterior tip make contact with the second surface.

As explained above with reference to FIGS. 1A-1B, A walker for aiding locomotion, the walker comprises a first (e.g., U-shaped) side frame comprising (i) a first anterior (e.g., front) frame portion having a first adjustable length, (ii) a first posterior (e.g., rear) frame portion having a second adjustable length, (iii) a first superior (e.g., upper) frame portion having a first fixed length and connecting an upper end of the first anterior frame portion with an upper end of the first posterior frame portion, and (iv) a first side support bar connecting the first anterior frame portion of the first side frame with the first posterior frame portion; and a second (e.g., U-shaped) side frame comprising (i) a second anterior (e.g., front) frame portion having a third adjustable length, (ii) a second posterior (e.g., rear) frame portion having a fourth adjustable length, (iii) a second superior (e.g., upper) frame portion having a second fixed length, connecting an upper end of the second anterior frame portion with an upper end of the second posterior frame portion, and (iv) a second side support bar connecting the second anterior frame portion of the second side frame with the second posterior frame portion of the second side frame.

As explained with reference to FIGS. 2A-2B, 3A-3B, and 4 below, when the first and second posterior frame portion (e.g., 106-*a* and 106-*b*) are placed on a first surface (e.g., first surface 250, FIGS. 2A-2B and 3A-3B) and the first and second anterior frame portion 104-*a* and 104-*b* are placed on a second surface, the first surface being at a predetermined elevation (e.g., H1) above the second surface: (i) the first and second side support bar 162-*a* and 162-*b* are parallel to both the first and second surface, and (ii) a substantially planar plank surface (e.g., surface 450, FIG. 4) balanced on the first and second side support bar lies in a plane parallel to both the first and second surface and forms a detachable seat.

Figure 2A:
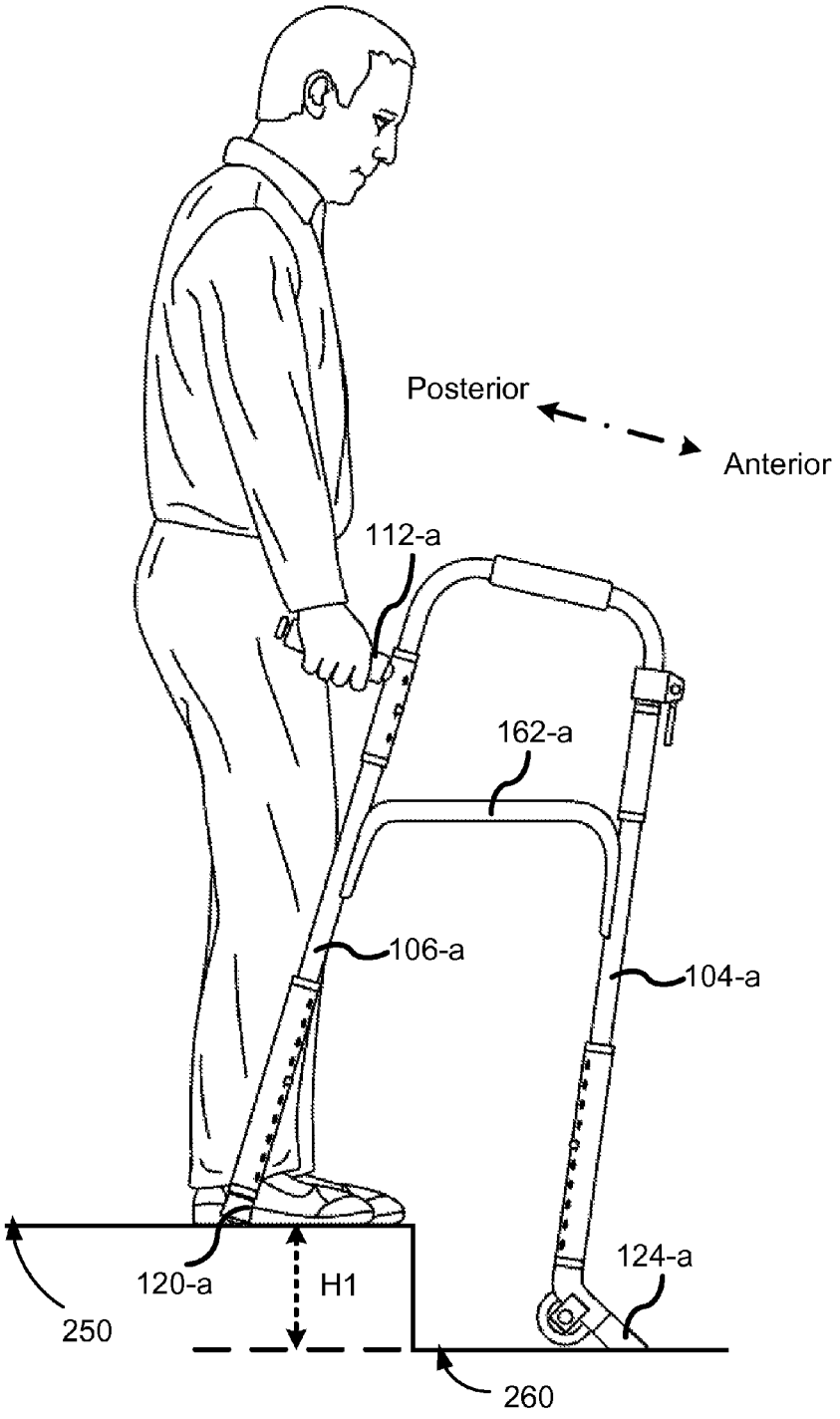
FIGS. 2A-2B illustrate a side view of a walking apparatus (e.g., a walker for aiding locomotion) positioned on a stairway (e.g., for use while walking down stairs), in accordance with some embodiments.
Figure 2B:
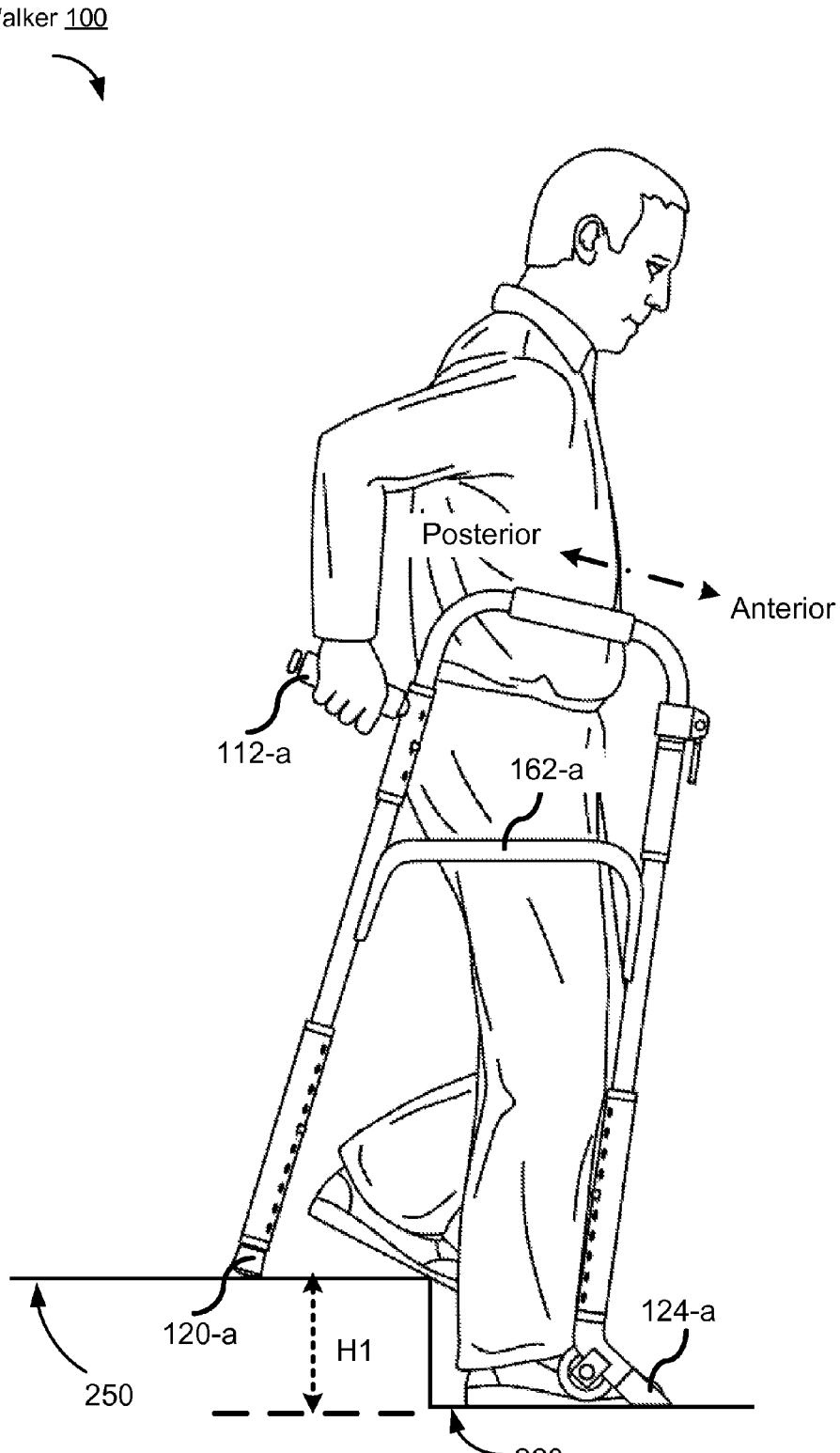
Figure 3A:
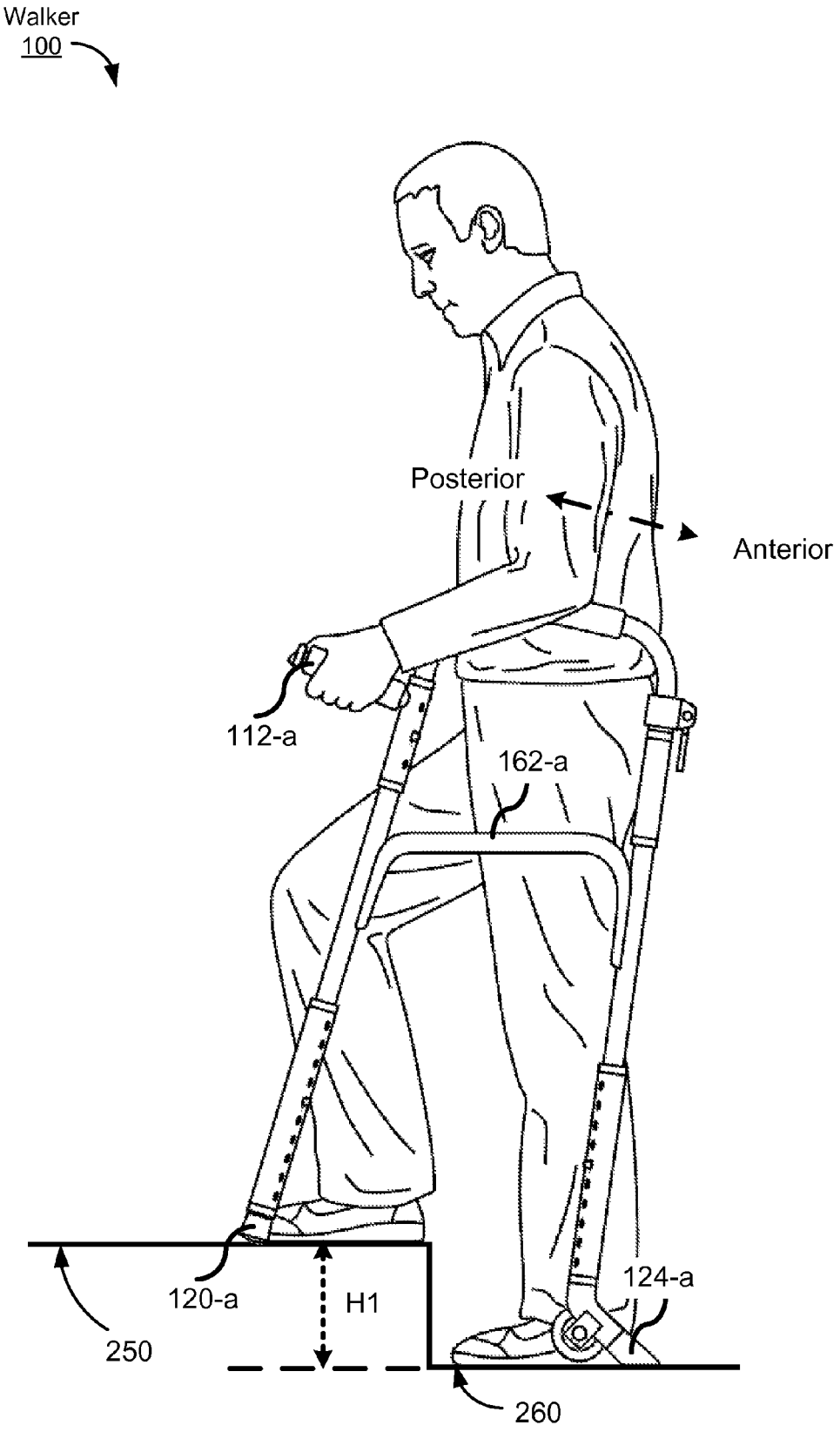
FIGS. 3A-3B illustrate a side view of a walking apparatus (e.g., a walker for aiding locomotion) positioned on a stairway (e.g., for use while walking up stairs), in accordance with some embodiments.
Figure 3B:
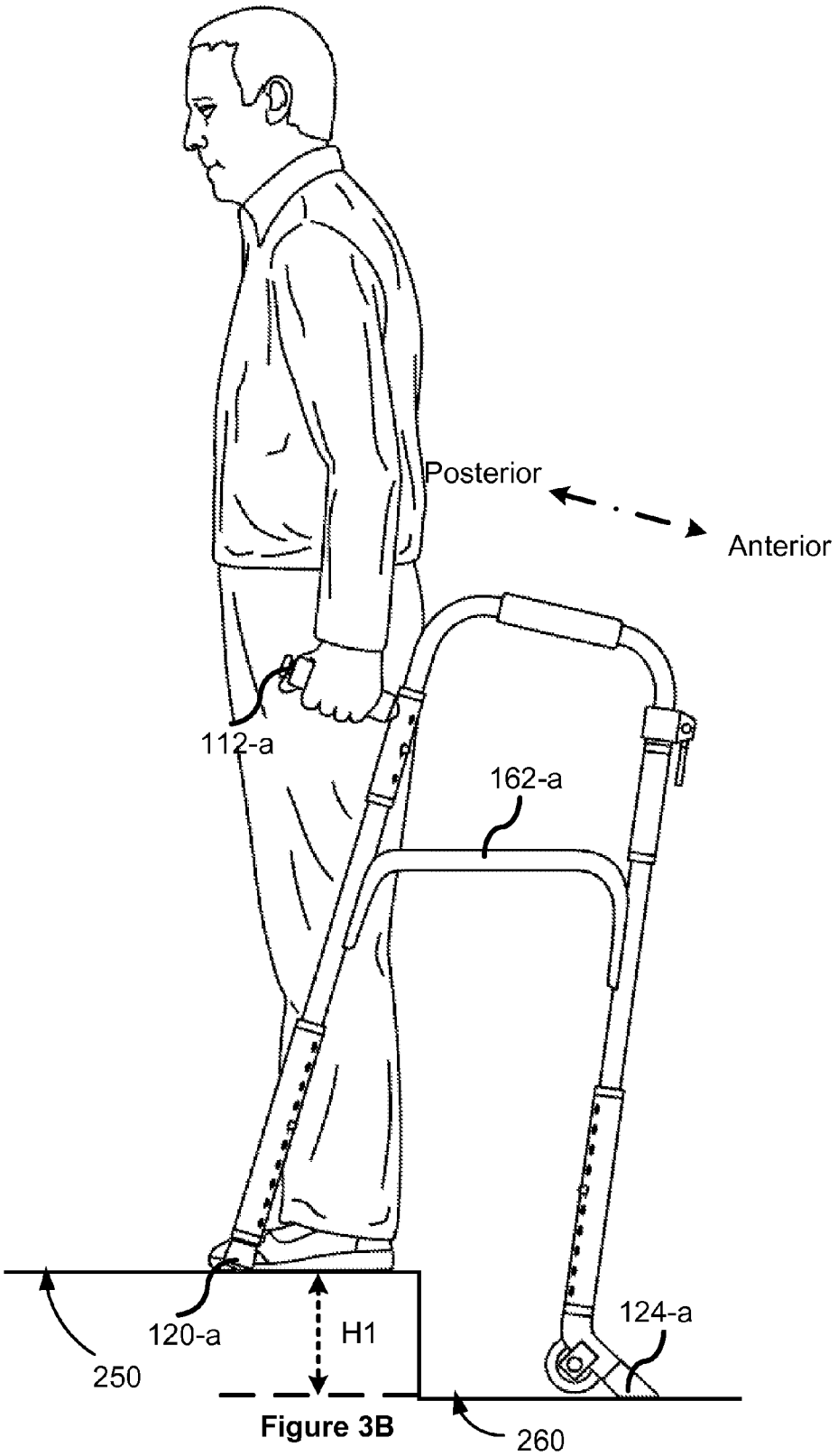

FIGS. 2A-2B illustrate a side view of a walking apparatus (e.g., a walker for aiding locomotion) positioned on a stairway (e.g., for use while walking down stairs), in accordance with some embodiments. FIGS. 3A-3B illustrate a side view of a walking apparatus (e.g., a walker for aiding locomotion) positioned on a stairway (e.g., for use while walking up stairs), in accordance with some embodiments.

In some embodiments, as shown in FIGS. 2A-2B and 3A-3B, when the first and second posterior frame portion (e.g., 106-*a* and 106-*b*) are placed on a first surface 250 and the first and second anterior frame portion 104-*a* and 104-*b* are placed on a second surface 260, the first surface being at a predetermined elevation H1 above the second surface (e.g., as shown in FIGS. 2A-2B and FIGS. 3A-3B), the first and second rotatable hand-rail 112-*a* and 112-*b* are configurable to extend posteriorly outward and parallel to the first and second side frame 102-*a* and 102-*b* thereby forming active hand supports on non-level surfaces.

In some embodiments, when each of the first and second posterior frame portion 106-*a* and 106-*b* as well as the first and second anterior frame portion 104-*a* and 104-*b* are placed on a third substantially planar surface (e.g., surface 450, FIGS. 5A-5B): (i) the first and second rotatable hand-rail 112-*a* and 112-*b* are configurable to fold anteriorly inward and parallel to the first and second side frame 102-*a* and 102-*b* thereby disallowing active use on a level surface, and (ii) a first stationary hand-rail 172-*a* on the first superior frame portion 108-*a* and a second stationary hand-rail 172-*b* on the second superior frame portion 108-*b* are configured to form active hand supports on level surfaces.

In other words, on the one hand, when positioned on non-level surfaces (e.g., on steps of a stairway), the first and second rotatable hand-rail 112-*a* and 112-*b* are foldable outward (facing the posterior side), to serve as hand-grips for providing stability and support to the person descending (e.g., as shown in FIGS. 2A-2B) or ascending (e.g., as shown in FIGS. 3A-3B) the stairs. On the other hand, when positioned on level surfaces (e.g., on a flat, level floor), the first and second rotatable hand-rail 112-*a* and 112-*b* are foldable inward (facing the anterior side) so as to prevent a user from using the rotatable hand-rails on the level surfaces, but to rather use first stationary hand-rail 172-*a* and second stationary hand-rail 172-*b* as hand-rails for providing stability and support while walking on level surfaces.

In some embodiments, when the first and second posterior frame portion 106-*a* and 106-*b* are placed on a first surface (e.g., surface 250, FIGS. 2A-2B and 3A-3B) and the first and second anterior frame portion 104-*a* and 104-*b* are placed on a second surface (e.g., surface 260, FIGS. 2A-2B and 3A-3B), the first surface being at a predetermined elevation (e.g., H1) above the second surface: (i) a substantial portion of a respective tip-base of the first tip 120-*a* and the second tip 120-*b* make contact with the first surface (e.g., surface 250, FIGS. 2A-2B and 3A-3B), and (ii) a substantial portion of a respective tip-base of the third tip 124-*a* and the fourth tip 124-*b* make contact with the second surface (e.g., surface 260, FIGS. 2A-2B and 3A-3B).

In some embodiments, the first surface (e.g., surface 250, FIGS. 2A-2B and 3A-3B) is a horizontal surface of a first step and the second surface (e.g., surface 260, FIGS. 2A-2B and 3A-3B) is a horizontal surface of a second step. The first step and the second step are consecutive steps in a stairway (e.g., as shown in FIGS. 2A-2B, and FIGS. 3A-3B). The second step is lower than the first step; and the horizontal surface of the first step and the horizontal surface of the second step are separated by a vertical surface of the first step. The vertical surface of the first step has a height corresponding to the predetermined elevation (e.g., H1).

Accordingly, when walker 100 is positioned on a stairway (e.g., to aide a person walking down or up the stairway, as shown in FIGS. 2A-2B and 3A-3B), a substantial portion of respective tip-bases of both anterior and both posterior side frames make substantial and firm contact with respective surfaces of steps of the stairway. As such, walker 100 provides additional stability (e.g., as a result of the firm contact made by the tip-bases of its side frames) to the user walking up or down the stairs. Optionally, first wheel 126-*a* and second wheel 126-*b* do not make (e.g., any) contact with the second surface (e.g., surface 260) thereby improving the stability of contact of the anterior frame portions with the second surface (e.g., by preventing slippage or rolling because of the wheel).

In some embodiments, when the first and second posterior frame portion (e.g., 106-*a* and 106-*b*) are placed on a first surface (e.g., surface 250, FIGS. 2A-2B and 3A-3B) and the first and second anterior frame portion (e.g., 104-*a* and 104-*b*) are placed on a second surface (e.g., surface 260, FIGS. 2A-2B and 3A-3B), the first surface being at a predetermined elevation (e.g., H1) above the second surface, the first and second side support bar (e.g., 162-*a* and 162-*b*) are parallel to both the first and second surface.

In some embodiments, when the first and second posterior frame portion (e.g., 106-*a* and 106-*b*) are placed on the first surface (e.g., surface 250, FIGS. 2A-2B and 3A-3B) and the first and second anterior frame portion (e.g., 104-*a* and 104-*b*) are placed on the second surface (e.g., surface 260, FIGS. 2A-2B and 3A-3B), a first ratio between the first and second adjustable lengths and a second ratio between the third and fourth adjustable lengths are configurable (e.g., by adjusting the first and second adjustable lengths using respective collars in respective lower regions of the first anterior frame portion and/or the first posterior frame portion; and by adjusting the third and fourth adjustable lengths using respective collars in respective lower regions of the second anterior frame portion and/or the second posterior frame portion) so as to align the first and second side support bar (e.g., 162-*a* and 162-*b*) parallel to both the first and second surface.

Figure 4:
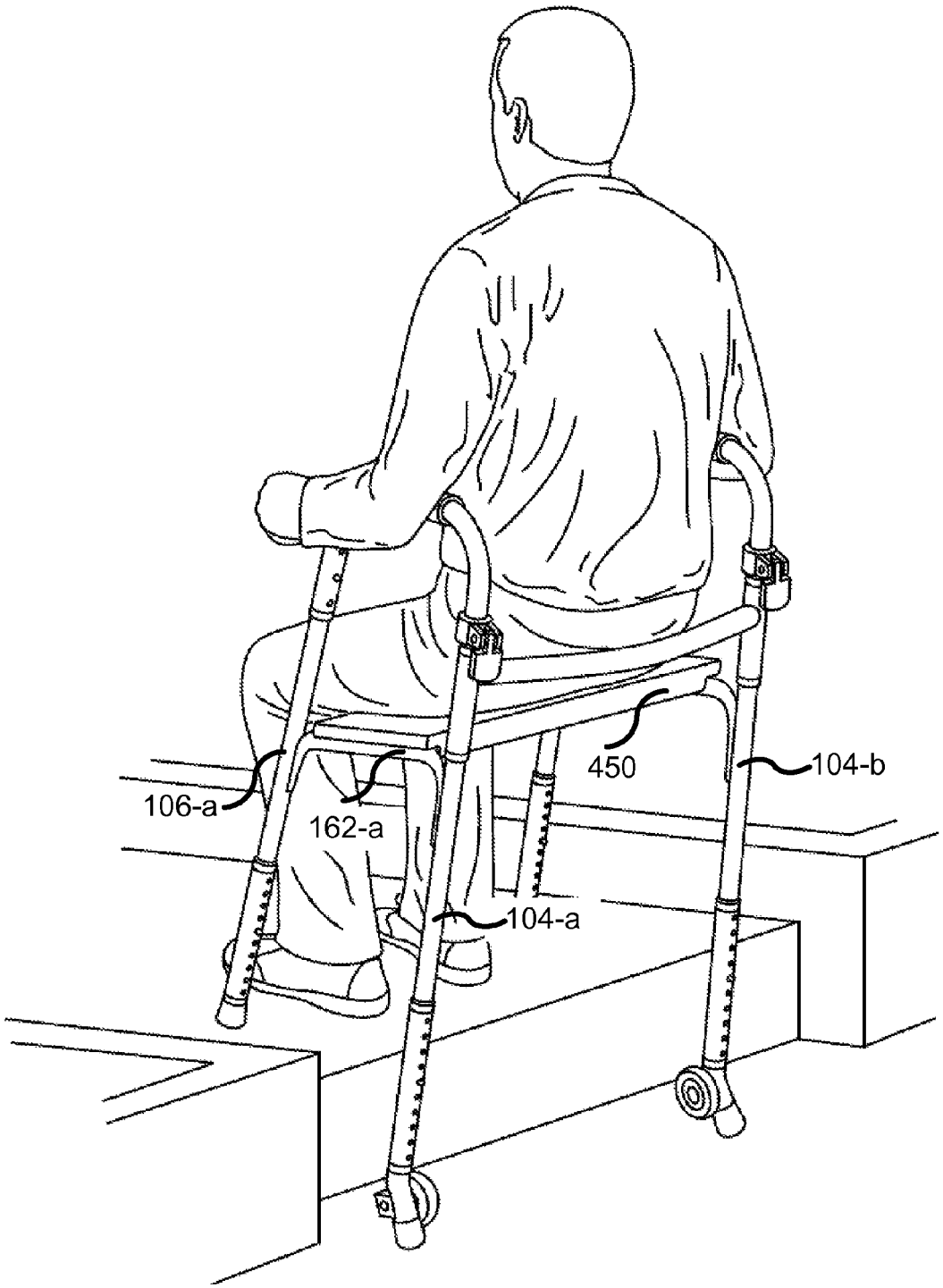
FIG. 4 illustrates a third perspective view of a walking apparatus positioned on the stairway (e.g., as being additionally, or alternatively used as a seating device on the stairs), in accordance with some embodiments.

FIG. 4 illustrates a third perspective view of a walking apparatus positioned on the stairway (e.g., as being additionally, or alternatively used as a seating device on the stairs), in accordance with some embodiments.

In some embodiments, as shown in FIG. 4, when the first and second posterior frame portion (e.g., 106-*a* and 106-*b*) are placed on the first surface (e.g., surface 250, FIGS. 2A-2B and 3A-3B) and the first and second anterior frame portion (e.g., 104-*a* and 104-*b*) are placed on the second surface (e.g., surface 260, FIGS. 2A-2B and 3A-3B), a substantially planar plank surface (e.g., plank surface 450, FIG. 4) balanced on the first and second side support bar (e.g., 162-*a* and 162-*b*) lies in a plane parallel to both the first and second surface and forms a detachable seat. Accordingly, if a user walking up or down a stairway or a flight of steps experiences fatigue, pain, exhaustion, or experiences the need to rest, the plank surface functions as a detachable seat on which the user can rest or sit (e.g., as shown in FIG. 4).

Figure 5A:
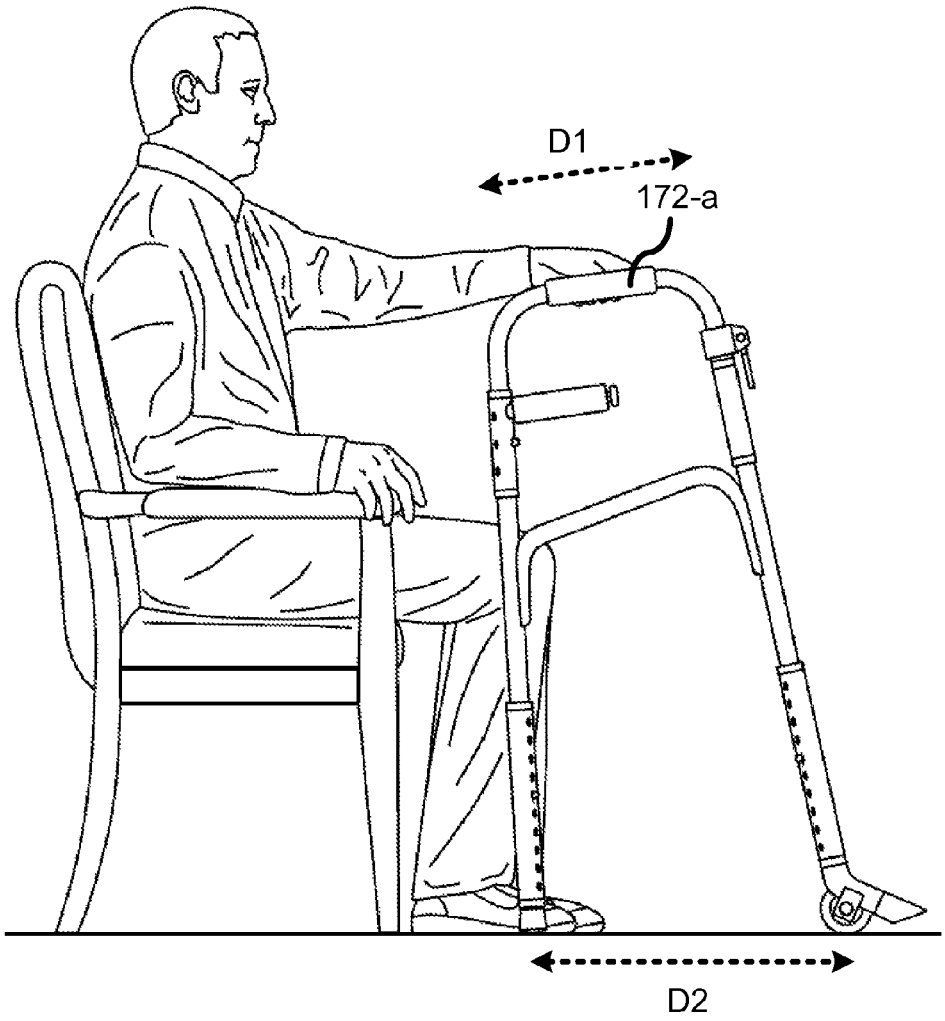
FIGS. 5A-5B illustrate a side view of a walking apparatus for use while standing up from a seated position, in accordance with some embodiments.
Figure 5B:
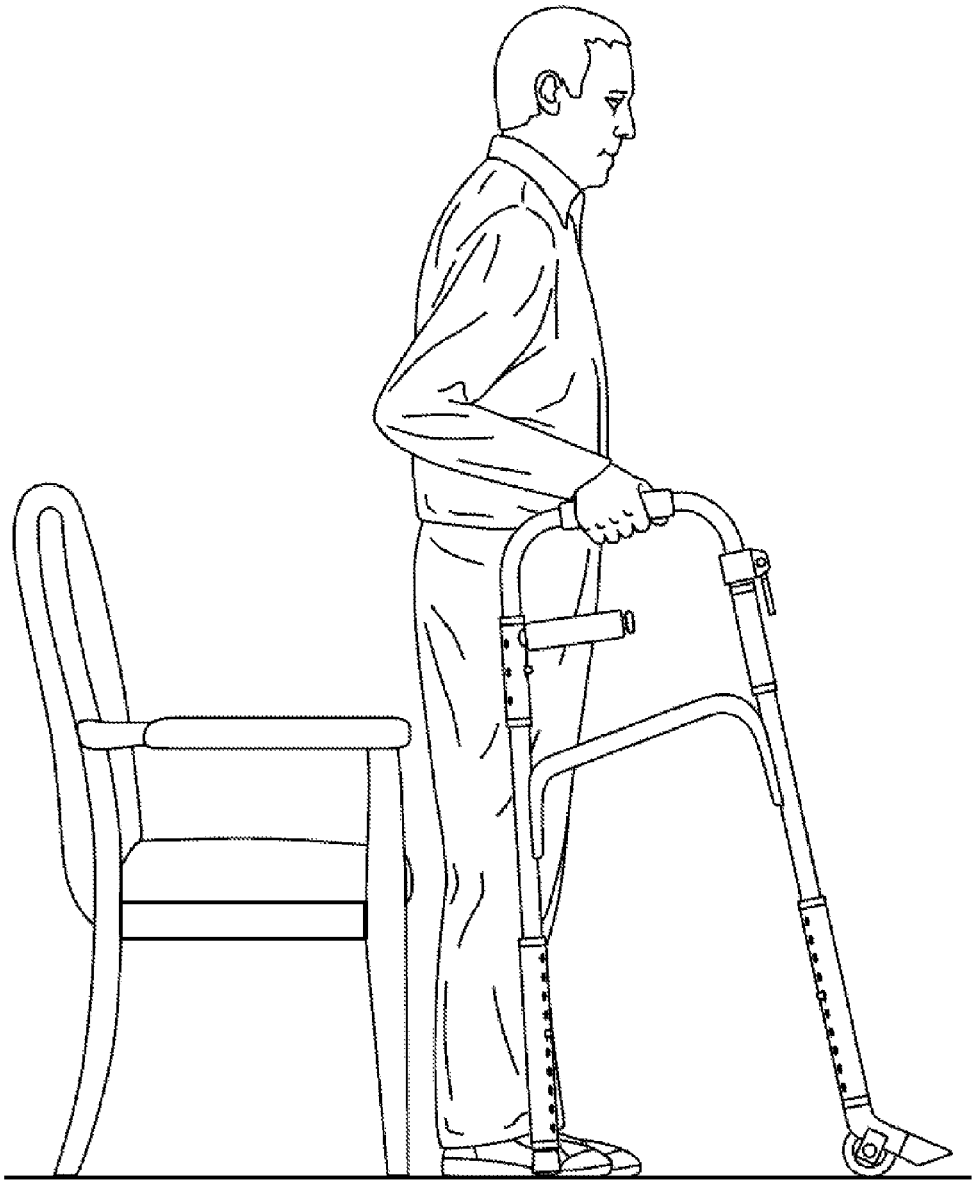

FIGS. 5A-5B illustrate a side view of a walking apparatus for use while standing up from a seated position, in accordance with some embodiments.

In some embodiments, when each of the first and second posterior frame portion (e.g., 106-*a* and 106-*b*) as well as the first and second anterior frame portion (e.g., 104-*a* and 104-*b*) are placed on a third substantially planar surface (e.g., a substantially planar surface or level surface 502, FIGS. 5A-5B), a first ratio between the first and second adjustable lengths and a second ratio between the third and fourth adjustable lengths are configurable (e.g., by adjusting the first and second adjustable lengths using respective collars in respective lower regions of the first anterior frame portion and/or the first posterior frame portion; and by adjusting the third and fourth adjustable lengths using respective collars in respective lower regions of the second anterior frame portion and/or the second posterior frame portion) so as to align the first and second side support bar parallel to the third surface.

In some embodiments, when each of the first and second posterior frame portion (e.g., 106-*a* and 106-*b*) as well as the first and second anterior frame portion (e.g., 104-*a* and 104-*b*) are placed on the third surface (e.g., a substantially planar surface or level surface 502, FIGS. 5A-5B), a substantially planar plank surface balanced on the first and second side support bar lies in a plane parallel to the third surface and forms a detachable seat.

In some embodiments, as shown in FIG. 5A, when each of the first and second posterior frame portion (e.g., 106-*a* and 106-*b*) as well as the first and second anterior frame portion (e.g., 104-*a* and 104-*b*) are placed on a third substantially planar surface (e.g., surface 502, FIGS. 5A-5B), an average (e.g., D1) of a first separation between the first tip (e.g., 120-*a*) and the third tip (e.g., 124-*a*) and a second separation between the second tip (e.g., 120-*b*) and the fourth tip (e.g., 124-*b*) is greater than an average (e.g., D2) of the first and second predefined lengths of first and second superior frame portion.

In some embodiments, the walker is further configured to stably assist a transition from seated to standing posture by way of pushing against a first stationary hand-rail (e.g., 172-*a*) on the first superior frame portion (e.g., 108-*a*) or against a second stationary hand-rail (e.g., 172-*b*) on the second superior frame portion (e.g., 108-*b*). The walker is configured to pivotally tilt on the first tip (e.g., 120-*a*) and the second tip (e.g., 120-*b*) of the lower end of the first and second posterior frame portion upon detecting a pull on the first stationary hand-rail or on the second stationary hand-rail thereby disallowing a transition from seated to standing posture by way of pulling against the first stationary hand-rail and the second stationary hand-rail.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A walker for aiding locomotion, the walker comprising:

a frame structure including:

a first side frame comprising (i) a first anterior frame portion having a first adjustable length, (ii) a first posterior frame portion having a second adjustable length, and (iii) a first superior frame portion having a first fixed length, wherein the first superior frame portion connects an upper end of the first anterior frame portion with an upper end of the first posterior frame portion; and a second side frame comprising (i) a second anterior frame portion having a third adjustable length, (ii) a second posterior frame portion having a fourth adjustable length, and (iii) a second superior frame portion having a second fixed length, wherein the second superior frame portion connects an upper end of the second anterior frame portion with an upper end of the second posterior frame portion;

wherein, the first posterior frame portion of the first side frame comprises a first upper posterior collar and the second posterior frame portion of the second side frame comprises a second upper posterior collar;

wherein, a first rotatable hand-rail is connected pivotally to the first upper posterior collar of the first posterior frame portion of the first side frame and a second rotatable hand-rail is connected pivotally to the second upper posterior collar of the second posterior frame portion of the second side frame;

an inter-frame support assembly including an anterior support bar connecting the first anterior frame portion of the first frame to the second anterior frame portion of the second frame; and an intra-frame support assembly including a first side support bar connecting the first anterior frame portion of the first side frame with the first posterior frame portion of the first side frame and a second side support bar connecting the second anterior frame portion of the second side frame with the second posterior frame portion of the second side frame, wherein, a lower end of the first posterior frame portion terminates in a first tip;

a lower end of the second posterior frame portion terminates in a second tip;

a lower end of the first anterior frame portion comprises (i) a first angular segment formed by a first bend in the lower end of the first anterior frame portion at a fixed angle relative to a remaining portion of the first anterior frame portion, the first angular segment terminating in a third tip, and (ii) a first wheel directly connected to the first angular segment through a first wheel-connection joint; and a lower end of the second anterior frame portion comprises (i) a second angular segment formed by a second bend in the lower end of the second anterior frame portion at the fixed angle relative to a remaining portion of the second anterior frame portion, the second angular segment terminating in a fourth tip, and (ii) a second wheel directly connected to the second angular segment through a second wheel-connection joint.

2. The walker of claim 1, wherein:

when the first and second posterior frame portion are placed on a first surface and the first and second anterior frame portion are placed on a second surface, the first surface being at a predetermined elevation above the second surface, the first and second rotatable hand-rail are configurable to extend posteriorly outward and parallel to the first and second side frame thereby forming active hand supports on non-level surfaces; and when each of the first and second posterior frame portion as well as the first and second anterior frame portion are placed on a third substantially planar surface:

(i) the first and second rotatable hand-rail are configurable to fold anteriorly inward and parallel to the first and second side frame thereby disallowing active use on a level surface, and (ii) a first stationary hand-rail on the first superior frame portion and a second stationary hand-rail on the second superior frame portion are configured to form active hand supports on level surfaces.

3. The walker of claim 1, wherein when the first and second posterior frame portion are placed on a first surface and the first and second anterior frame portion are placed on a second surface, the first surface being at a predetermined elevation above the second surface, (i) a substantial portion of a respective tip-base of the first tip and the second tip make contact with the first surface, and (ii) a substantial portion of a respective tip-base of the third tip and the fourth tip make contact with the second surface.

4. The walker of claim 3, wherein:

the first surface is a horizontal surface of a first step and the second surface is a horizontal surface of a second step;

the first step and the second step are consecutive steps in a stairway;

the second step is lower than the first step; and the horizontal surface of the first step and the horizontal surface of the second step are separated by a vertical surface of the first step;

the vertical surface of the first step has a height corresponding to the predetermined elevation.

5. The walker of claim 1, wherein when the first and second posterior frame portion are placed on a first surface and the first and second anterior frame portion are placed on a second surface, the first surface being at a predetermined elevation above the second surface, the first and second side support bar are parallel to both the first and second surface.

6. The walker of claim 5, wherein when the first and second posterior frame portion are placed on the first surface and the first and second anterior frame portion are placed on the second surface, a first ratio between the first and second adjustable lengths and a second ratio between the third and fourth adjustable lengths are configurable so as to align the first and second side support bar parallel to both the first and second surface.

7. The walker of claim 5, wherein, when the first and second posterior frame portion are placed on the first surface and the first and second anterior frame portion are placed on the second surface, a substantially planar plank surface balanced on the first and second side support bar lies in a plane parallel to both the first and second surface and forms a detachable seat.

8. The walker of claim 1, wherein when each of the first and second posterior frame portion as well as the first and second anterior frame portion are placed on a third substantially planar surface, a first ratio between the first and second adjustable lengths and a second ratio between the third and fourth adjustable lengths are configurable so as to align the first and second side support bar parallel to the third surface.

9. The walker of claim 8, wherein when each of the first and second posterior frame portion as well as the first and second anterior frame portion are placed on the third surface, a substantially planar plank surface balanced on the first and second side support bar lies in a plane parallel to the third surface and forms a detachable seat.

10. The walker of claim 1, wherein:

the first posterior frame portion of the first side frame further comprises a first lower posterior collar;

the second posterior frame portion of the second side frame further comprises a second lower posterior collar;

the first anterior frame portion of the first side frame comprises a first lower anterior collar; and the second anterior frame portion of the second side frame comprises a second lower anterior collar.

11. The walker of claim 10, wherein:

the first and second lower anterior collar each comprises N slots, where N is a positive integer between 5 and 12; and the first and second lower anterior frame portion each comprises a protrusion configured to correspondingly lock into one of the N slots when the first and second lower anterior collar slidably engage correspondingly with the first and second anterior frame portion, thereby correspondingly defining the first and third adjustable length.

12. The walker of claim 10, wherein:

the first and second lower posterior collar each comprises M slots, where M is a positive integer between 5 and 12; and the first and second lower posterior frame portion each comprises a protrusion configured to correspondingly lock into one of the M slots when the first and second lower posterior collar slidably engage correspondingly with the first and second posterior frame portion, thereby correspondingly defining the second and fourth adjustable length.

13. The walker of claim 10, wherein one or more of the first and second upper posterior collar, the first and second lower posterior collar, and the first and second lower anterior collar are coated in a first predetermined color and one or more corresponding rims of the one or more respective collars are coated in a second predetermined color.

14. The walker of claim 1, wherein when each of the first and second posterior frame portion as well as the first and second anterior frame portion are placed on a third substantially planar surface, an average of a first separation between the first tip and the third tip and a second separation between the second tip and the fourth tip is greater than an average of the first and second predefined lengths of first and second superior frame portion.

15. The walker of claim 1, wherein:

the walker is further configured to stably assist a transition from seated to standing posture by way of pushing against a first stationary hand-rail on the first superior frame portion or against a second stationary hand-rail on the second superior frame portion; and the walker is configured to pivotally tilt on the first tip and the second tip of the lower end of the first and second posterior frame portion upon detecting a pull on the first stationary hand-rail or on the second stationary hand-rail thereby disallowing a transition from seated to standing posture by way of pulling against the first stationary hand-rail and the second stationary hand-rail.

16. The walker of claim 1, wherein the first and second anterior frame portion comprise respective first and second actuation tongues for collapsibly folding the walker upon actuation, the first and second actuation tongues extending anteriorly outward to prevent accidental actuation and folding of the walker.

17. A walker for aiding locomotion, the walker comprising:

a first side frame comprising (i) a first anterior frame portion having a first adjustable length, (ii) a first posterior frame portion having a second adjustable length, (iii) a first superior frame portion having a first fixed length and connecting an upper end of the first anterior frame portion with an upper end of the first posterior frame portion, and (iv) a first side support bar connecting the first anterior frame portion of the first side frame with the first posterior frame portion; and a second side frame comprising (i) a second anterior frame portion having a third adjustable length, (ii) a second posterior frame portion having a fourth adjustable length, (iii) a second superior frame portion having a second fixed length, connecting an upper end of the second anterior frame portion with an upper end of the second posterior frame portion, and (iv) a second side support bar connecting the second anterior frame portion of the second side frame with the second posterior frame portion of the second side frame;

wherein, when the first and second posterior frame portion are placed on a first surface and the first and second anterior frame portion are placed on a second surface, the first surface being at a predetermined elevation above the second surface:

(i) the first and second side support bar are parallel to both the first and second surface, and (ii) a substantially planar plank surface balanced on the first and second side support bar lies in a plane parallel to both the first and second surface and forms a detachable seat, wherein, a lower end of the first posterior frame portion terminates in a first tip;

a lower end of the second posterior frame portion terminates in a second tip;

a lower end of the first anterior frame portion comprises (i) a first angular segment formed by a first bend in the lower end of the first anterior frame portion at a fixed angle relative to a remaining portion of the first anterior frame portion, the first angular segment terminating in a third tip, and (ii) a first wheel directly connected to the first angular segment through a first wheel-connection joint; and a lower end of the second anterior frame portion comprises (i) a second angular segment formed by a second bend in the lower end of the second anterior frame portion at the fixed angle relative to a remaining portion of the second anterior frame portion, the second angular segment terminating in a fourth tip, and (ii) a second wheel directly connected to the second angular segment through a second wheel-connection joint.

* * * * *